US007231863B2

(12) United States Patent
Domeij

(10) Patent No.: US 7,231,863 B2
(45) Date of Patent: Jun. 19, 2007

(54) ARRANGEMENT FOR TRANSFERRING LARGE-CALIBRE AMMUNITION FROM AN AMMUNITION MAGAZINE TO LOADING POSITION IN A LARGE-CALIBRE WEAPON

(75) Inventor: Sture Domeij, Ornskoldsvik (SE)

(73) Assignee: BAE Systems Hagglunds Aktiebolag, Ornskoldsvik (SE)

( * ) Notice: Subject to any disclaimer, the term of this patent is extended or adjusted under 35 U.S.C. 154(b) by 73 days.

(21) Appl. No.: 10/866,797

(22) Filed: Jun. 15, 2004

(65) Prior Publication Data

US 2005/0022659 A1 Feb. 3, 2005

Related U.S. Application Data

(62) Division of application No. 10/309,184, filed on Dec. 4, 2002, now Pat. No. 6,769,344.

(30) Foreign Application Priority Data

Dec. 5, 2001 (SE) ..... 0104079

(51) Int. Cl.
*F41A 9/16* (2006.01)

(52) U.S. Cl. ..... 89/46

(58) Field of Classification Search ..... 89/45–47, 89/33.04, 33.05, 36.08, 33.1, 1.41
See application file for complete search history.

(56) References Cited

U.S. PATENT DOCUMENTS 2,851,928 A * 9/1958 Martensson et al. ..... 89/45
3,106,866 A 10/1963 Klapodhr et al.
3,855,899 A 12/1974 Billottet et al.
4,038,906 A 8/1977 Tidstrom
4,079,659 A * 3/1978 Gustavsson et al. ..... 89/46
4,092,901 A * 6/1978 Gustavsson et al. ..... 89/46
4,388,854 A * 6/1983 Dabrowski et al. ..... 89/46
4,429,616 A * 2/1984 Grosser ..... 89/36.13
4,457,209 A * 7/1984 Scheurich et al. ..... 89/45

(Continued)

FOREIGN PATENT DOCUMENTS

GB 2153496 A * 8/1985

(Continued)

*Primary Examiner*—Troy Chambers
(74) *Attorney, Agent, or Firm*—Young & Thompson

(57) ABSTRACT

The invention relates to an arrangement (18) for retrieving large-calibre ammunition (10), such as shells, from an ammunition magazine and transferring these to a loading and ramming position, in which the respective ammunition unit (10) is located directly behind and coaxially aligned with a barrel (20) of a large-calibre weapon which is mounted in such a way that it can pivot around a horizontal axis (22) to assume different elevation positions. The transferring arrangement comprises a swing arm (26) which is mounted in such a way that it can pivot around the said horizontal axis (22) between a retrieving position and a delivery position for each ammunition unit, and an ammunition pickup unit (30) which is mounted on the swing arm (26) in such a way that it can pivot. The ammunition pickup unit (30) is arranged to assume a first angular position relative to the swing arm (26) when this assumes its retrieving position, and to assume a second angular position relative to the swing arm when this assumes its delivery position.

4 Claims, 4 Drawing Sheets

U.S. PATENT DOCUMENTS

| | | | | | |
|---|---|---|---|---|---|
| 4,481,862 | A | * | 11/1984 | Wiethoff et al. | 89/46 |
| 4,706,544 | A | * | 11/1987 | Zielinski et al. | 89/46 |
| 4,730,536 | A | * | 3/1988 | Nordmann | 89/45 |
| 4,819,518 | A | * | 4/1989 | Pahnke | 89/46 |
| 4,823,675 | A | | 4/1989 | Schiele et al. | |
| 4,838,144 | A | * | 6/1989 | Bierwirth et al. | 89/46 |
| 4,966,064 | A | * | 10/1990 | Kaustrater et al. | 89/46 |
| 4,991,489 | A | * | 2/1991 | Lindberg | 89/6.5 |
| 5,111,730 | A | * | 5/1992 | Grabner | 89/45 |
| 5,267,503 | A | * | 12/1993 | Grabner | 89/46 |
| 5,307,726 | A | * | 5/1994 | Stubbs | 89/36.13 |
| 5,604,327 | A | | 2/1997 | Skoglund et al. | |
| 5,728,966 | A | | 3/1998 | Bobinger et al. | |
| 5,773,747 | A | * | 6/1998 | Tellander et al. | 89/47 |
| 5,844,163 | A | | 12/1998 | Lindskog | |
| 5,965,837 | A | | 10/1999 | Lee et al. | |
| 6,026,729 | A | * | 2/2000 | Hallqvist | 89/46 |
| 6,095,026 | A | | 8/2000 | Poussard et al. | |
| 6,481,328 | B1 | | 11/2002 | Hallqvist | |
| 6,591,733 | B1 | | 7/2003 | Engstrom | |
| 6,694,857 | B2 | * | 2/2004 | Eriksson | 89/47 |

FOREIGN PATENT DOCUMENTS

| | | |
|---|---|---|
| SE | 500 600 | 7/1994 |
| SE | 513 006 | 6/2000 |
| WO | 96/12152 | 4/1996 |

* cited by examiner

ARRANGEMENT FOR TRANSFERRING LARGE-CALIBRE AMMUNITION FROM AN AMMUNITION MAGAZINE TO LOADING POSITION IN A LARGE-CALIBRE WEAPON

CROSS REFERENCE TO RELATED APPLICATION

This application is a division of application Ser. No. 10/309,184, filed on Dec. 4, 2002, now U.S. Pat. No. 6,769,344 the entire contents of which are hereby incorporated by reference.

TECHNICAL FIELD

The present invention relates to an arrangement for retrieving large-calibre ammunition, such as shells, from an ammunition magazine and transferring these to a loading and ramming position, in which the respective ammunition unit is located directly behind and coaxially aligned with a barrel of a large-calibre weapon, which weapon is mounted in such a way that it can pivot around a horizontal axis to assume different elevation positions, which arrangement comprises a swing arm which is mounted in such a way that it can pivot around the said horizontal axis between a retrieving position and a delivery position for each ammunition unit, and an ammunition pickup unit which is mounted on the swing arm at a distance from the swing arm's axis of rotation in such a way that it can pivot, the ammunition pickup unit being arranged to assume a first angular position relative to the swing arm when this assumes its retrieving position, and to assume a second angular position relative to the swing arm when this assumes its delivery position, the position of the ammunition pickup unit upon assuming the first angular position being such that a recoil movement can be made by the barrel without it colliding with the ammunition pickup unit. In particular, but not exclusively, the invention relates to such an arrangement for mounting in a gun turret of an armoured vehicle, where by means of a simple construction the arrangement makes possible direct transferring of ammunition units from the magazine to the weapon and makes possible a very compact design of the gun turret.

BACKGROUND ART

Gun turrets which house large-calibre weapons, such as mortars and possibly guns, and where the ammunition magazine is located relatively close to the weapon, have previously been difficult to give a relatively small and compact design on account of the mechanism for retrieving and loading the ammunition requiring space so that it is not in the way of the rear end of the weapon when this recoils upon firing. In order to make possible handling of ammunition in this way, known mechanisms have had a complicated and relatively bulky design, which has made it difficult to give the gun turret a compact design at the same time.

SE 513 006 C2 describes a known arrangement of the type described in the introduction for loading a large-calibre weapon (gun) with artillery shells, where the ammunition pickup unit is arranged, after insertion of a shell from a magazine located to the rear, first to be pivoted around a rear axis by means of guide curves attached to the gun and a link system into such an angular position relative to the swing arm that the shell can assume an angle that approximately corresponds to the elevation of the gun, after which the shell is released from the ammunition pickup unit and is transferred to a separate shell cradle which is then moved sideways on guide rails attached to the gun into a position for insertion of the shell into the barrel of the gun by means of a ram on the cradle. This arrangement is relatively complicated and does not allow direct transferring of a shell from a magazine to a loading position by means of only one pivoting movement of the swing arm and the ammunition pickup unit mounted upon it.

SE 500 600 C2 shows a known mortar arrangement, where two or more barrels are arranged parallel to each other in a common cradle.

OBJECT OF THE INVENTION AND SOLUTION

An object of the present invention is to achieve an arrangement for retrieving ammunition units from an ammunition magazine and thereafter direct transferring of the same to a loading position by means of a simple device which takes up little space in a gun turret and which can be adapted to retrieve ammunition units from ammunition magazines located at different places in the gun turret with ammunition either oriented essentially horizontally and pointing forwards in a rear part of a superstructure of the gun turret, or oriented vertically or horizontally in a lower tray of the gun turret.

To fulfil this object, the arrangement according to the invention described in the introduction is characterized in that the ammunition pickup unit is mounted on the swing arm in such a way that, while assuming a second angular position relative to the swing arm in which an extension of the longitudinal axis of the ammunition unit essentially intersects the horizontal axis of rotation of the swing arm, it transfers the ammunition unit in a vertical plane through the central axis of the barrel to a position directly behind the barrel, when the swing arm is pivoted to its delivery position. By this means, a simple and compact loading mechanism is achieved, which can directly transfer an ammunition unit from a magazine to a loading position behind the gun by movement of the ammunition unit in a single vertical plane which essentially coincides with a vertical plane through the longitudinal central axis of the barrel.

A preferred characteristic common to the various embodiments of the arrangement according to the invention, is that the ammunition pickup unit is arranged to be brought to the first angular position by making contact with a fixed contact surface inside the gun turret. In addition, the ammunition pickup unit is preferably urged towards the second angular position by means of the force of a spring device, when the unit is not in contact with the contact surface. Alternatively, the ammunition pickup unit can be mounted in such a way on the swing arm that it can be brought towards the second angular position by the force of gravity acting on the unit and the shell located therein, when the unit is not in contact with the contact surface.

Further characteristics and advantages of the arrangement according to the invention will be revealed in greater detail in the following detailed description with reference to the attached drawings.

BRIEF DESCRIPTION OF THE DRAWINGS

FIG. 1(*b*) is a plan view of the embodiment in FIG. 1(*a*);

FIG. 1(*c*) is a view similar to FIG. 1(*a*), but shows the swing arm and the ammunition pickup unit in a second position at an angle to each other, which they assume by a pivoting movement from the retrieving position to the loading position;

FIG. 1(*d*) is a view similar to FIGS. 1(*a*) and (*c*), but shows the arrangement in a loading position directly behind a mortar;

FIG. 1(*e*) is a plan view of the arrangement in FIG. 1(*d*);

FIG. 4(*b*) is a view similar to FIG. 4(*a*), but shows the swing arm and the ammunition pickup unit in a second position at an angle to each other, that they assume by a pivoting movement from the retrieving position to the loading position;

FIG. 4(*c*) is a view similar to FIGS. 4(*a*) and 4(*b*), but shows the arrangement in a loading position directly behind a mortar;

FIG. 5(*b*) is a view similar to FIG. 5(*a*), but shows the swing arm and the ammunition pickup unit in a second position at an angle to each other, that they assume by a pivoting movement from the retrieving position to the loading position; and FIG. 5(*c*) is a view similar to FIGS. 5(*a*) and 5(*b*), but shows the arrangement in a loading position directly behind a mortar.

DESCRIPTION OF PREFERRED EMBODIMENTS OF THE INVENTION

Figure 1A:
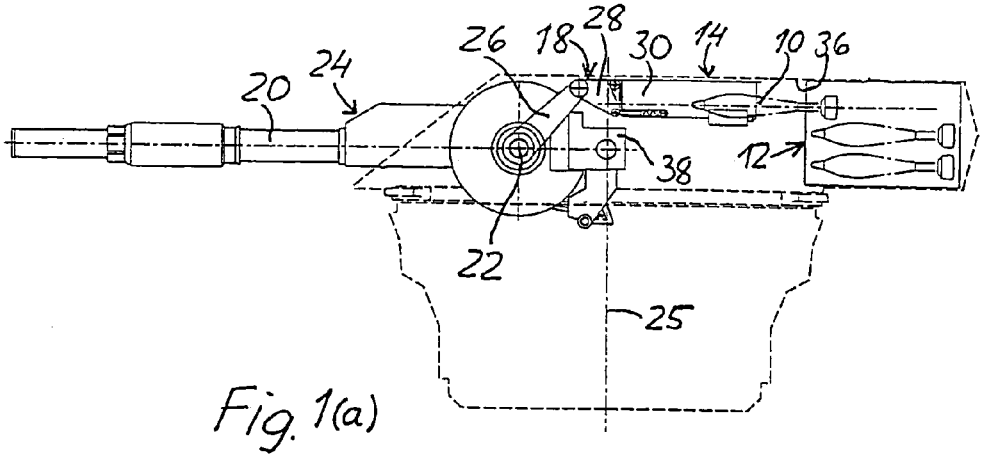
FIG. 1(*a*) is a schematic side view of a first embodiment of an arrangement according to the present invention, where a swing arm and an ammunition pickup unit in a retrieving position assume a first position at an angle to each other, in which a shell has just been received in a horizontal position from an ammunition magazine located at the back in a gun turret superstructure.
Figure 1B:
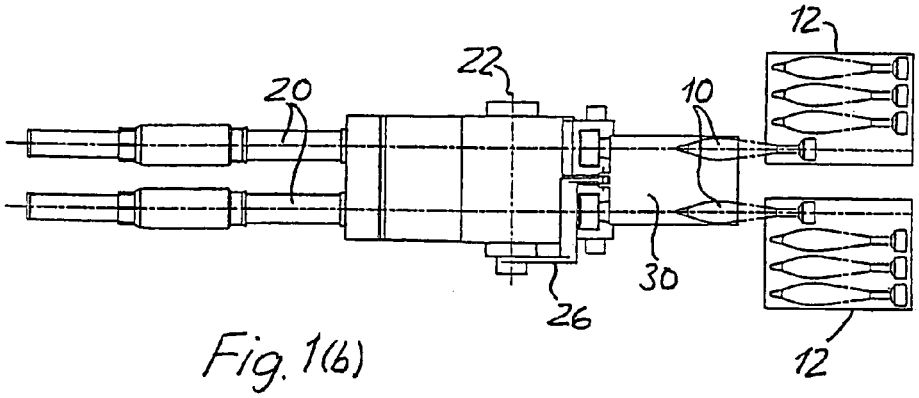
Figure 1C:
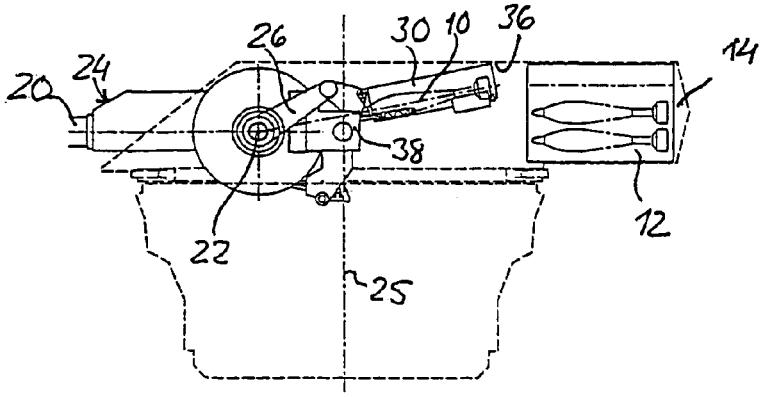
Figure 1D:
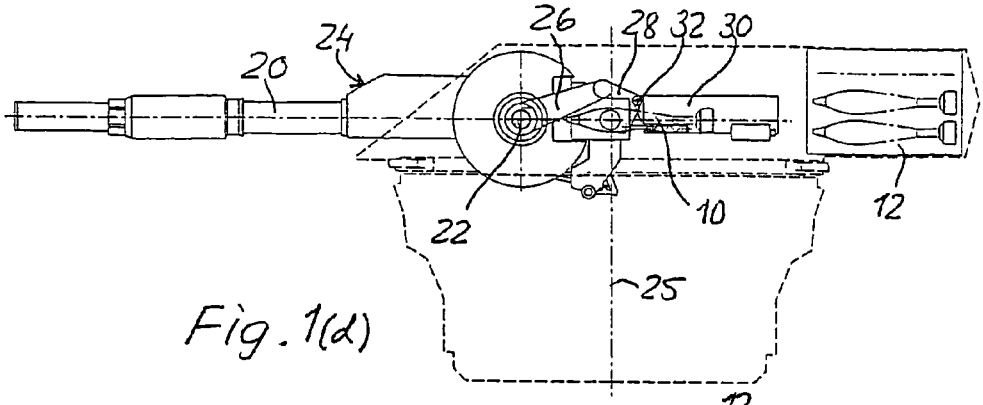
Figure 1E:
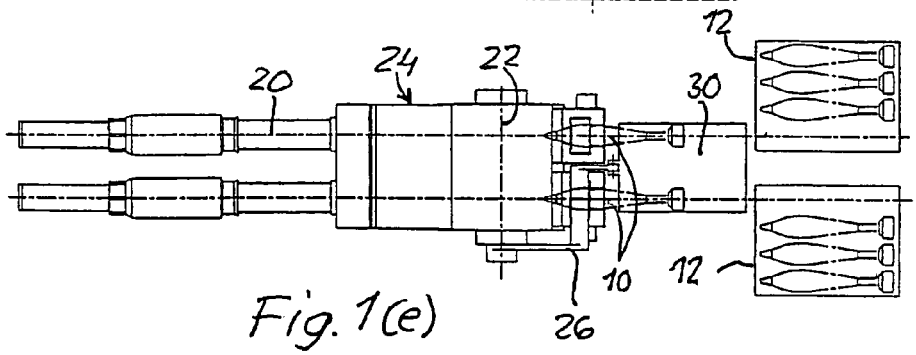

FIGS. 1(*a, c, d*) show in sequence how a large-calibre ammunition unit, in this case a shell 10, is retrieved from an ammunition magazine 12 in a rear part of a superstructure 14 of a gun turret 16 and is moved by means of a transferring mechanism 18 according to the invention to a loading or ramming position directly behind a barrel 20 of a large-calibre weapon, in this case a mortar 24, mounted in such a way that it can pivot around a horizontal axis 22 in the gun turret 16. The gun turret 16 is mounted in such a way that it can pivot around a vertical axis 25 and can be mounted on an armoured vehicle intended for the purpose. As shown in FIGS. 1(*b* and *e*), the mortar 24 is a double-barrelled design with two barrels mounted alongside each other on the same horizontal axis 22, with double ammunition magazines 12 and transferring mechanisms 18 co-ordinated with the barrels 20 of the mortar 24. Even though two guns and magazines are arranged in parallel with each other in FIGS. 1(*a–e*), it is, of course, possible to use the invention with a version of a weapon with a single barrel.

Figure 2:
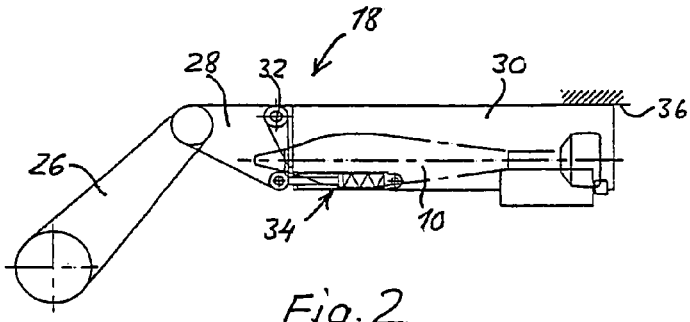
FIG. 2 is an enlarged side view of the swing arm and the ammunition pickup unit in the first position at an angle to each other according to FIG. 1(*a*)
Figure 3:
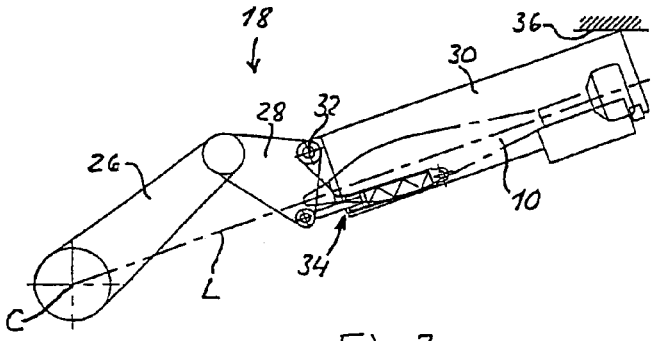
FIG. 3 is a side view similar to FIG. 2, but shows the swing arm and the ammunition pickup unit in the second position at an angle to each other according to FIGS. 1(*c*) and (*d*)

As shown in greater detail in FIGS. 2 and 3, each transferring mechanism 18 comprises a swing arm 26 that is mounted in such a way that it can pivot around the horizontal axis 22, which swing arm has at its outer end an auxiliary arm 28 angled away from the swing arm 26. In addition, the transferring mechanism 18 comprises an ammunition pickup unit 30 which is mounted on the auxiliary arm 28 in such a way that it can pivot to a limited extent on a bearing 32. In a shell-receiving position according to FIGS. 1(*a, b*) and 2, the shell pickup unit 30 is arranged to assume a first angular position relative to the swing arm 26 against the effect of a spring device 34, which, for example, can comprise a spring-action piston-cylinder arrangement or some functionally equivalent alternative. The shell pickup unit 30 is held in this position by the swing arm 26 pressing it against a contact surface 36 located above it, which contact surface can consist of a part of the underside of the turret superstructure 14. In this position, the transferring mechanism 18 has a position and a configuration that allows recoiling of the mortar 24, without its rear end 38 colliding with the transferring mechanism 30, with minimal requirement for space for the mechanism and allowing the height of the gun turret 16 to be as low as possible, while at the same time a new shell 10 can be inserted axially in the unit 30 from the magazine 12 by means of a ram (not shown).

FIGS. 1(*c*) and 3 show how the spring device 34 brought the shell pickup unit 30 into a second angular position relative to the swing arm 26, when this commenced its rotation clockwise towards a loading position behind the mortar 24. During this initial rotational movement of the swing arm 26, the rear upper corner of the unit 30 is held in contact with the contact surface 36 by means of the spring device 34. Thereafter the unit 30 is pivoted to the loading position shown in FIG. 1(*d*), in which the shell 10 is first held directly behind the breech of the weapon and coaxially aligned with the central axis of the barrel 20 and thereafter is inserted in the weapon's barrel by means of a ram (not shown), that can be integrated with the unit 30. In the second angular position, the unit 30 assumes a position such that an imaginary extension L forwards of the shell's 10 longitudinal axis intersects the central axis C of the swing arm 26, which central axis preferably coincides coaxially with the weapon's horizontal axis of rotation 22 (FIG. 3). By means of such an arrangement, shells can simply and quickly be transferred direct from a magazine to a correct elevation-matched loading position behind the gun by moving the shell in a single vertical plane, which essentially coincides with a vertical plane through the longitudinal central axis of the barrel.

In the embodiment described above, the transferring mechanism 18 according to the invention is arranged to retrieve and load ammunition stored horizontally and pointing forward in a magazine 12 in a rear part of the turret superstructure 14. The magazine 12 can thus be of the revolver type that is described in SE-C-514 536.

Figure 4A:
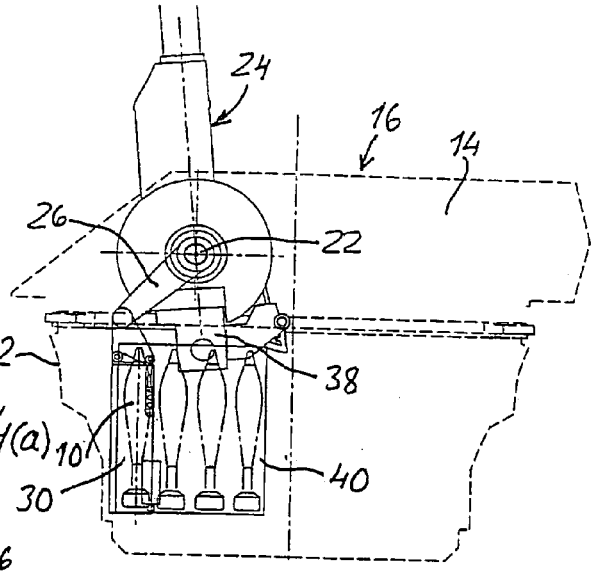
FIG. 4(*a*) is a schematic side view of a second application of an arrangement according to the present invention, where a swing arm and an ammunition pickup unit in a retrieving position assume a first position at an angle to each other, in which a shell has just been received in a vertical position from an ammunition magazine located in an underlying tray of a gun turret.
Figure 4B:
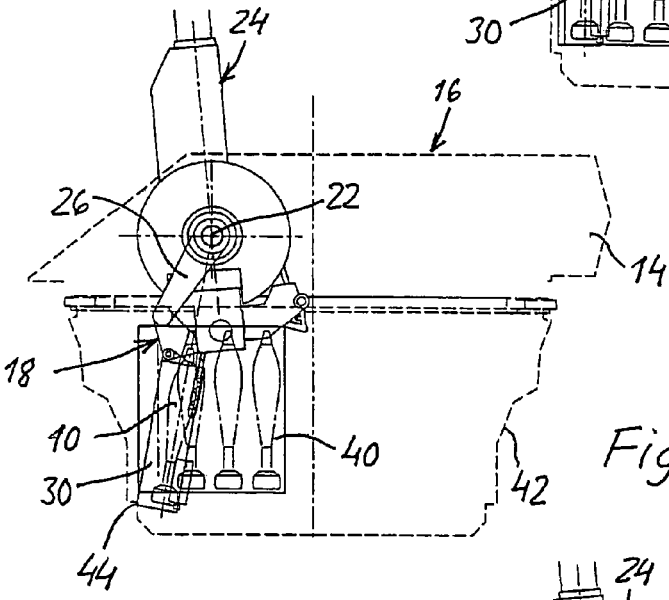
Figure 4C:
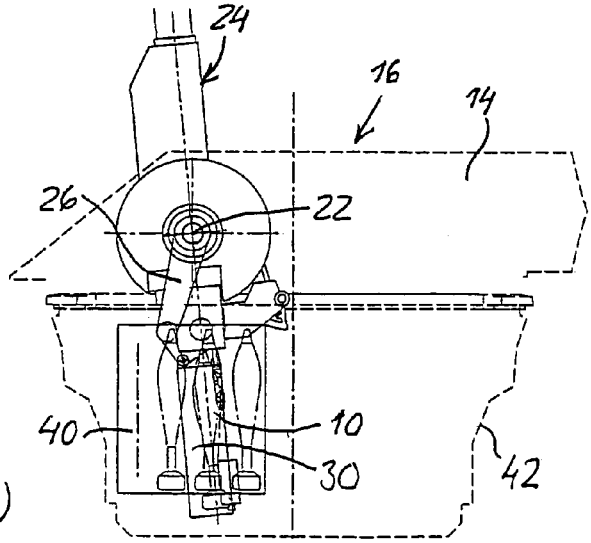

FIGS. 4(*a–c*) show another application of the transferring mechanism 18 according to the invention, namely where an ammunition magazine 40 is located in a lower tray 42 in the gun turret 16 and is arranged to feed out shells 10 radially in a vertical position. In this case, the swing arm 26 with the shell pickup unit 30 mounted upon it is mounted in contrast on the horizontal axis 22 in such a way that it can pivot, with the shell pickup unit 30 in the retrieving or receiving position in FIG. 4(*a*) in contact with a vertical contact surface 44 on, for example, a front wall of the turret tray 42. The unit 30 is hereby held in the first angular position relative to the swing arm 26 against the effect of the spring device 34, in a corresponding way to that shown in FIGS. 1(*a*) and 2, in which the mortar 24 loaded in the preceding loading phase can be fired without its rear end 38 colliding with the transferring mechanism 18. Thereafter the mechanism 18 can be pivoted to an elevation-matched loading or ramming position behind the mortar 24, as shown in FIG. 4(*c*), via the intermediate position in FIG. 4(*b*), where the shell pickup unit 30 is caused to assume the second angular position relative to the swing arm 26 by means of the spring device 34 (FIGS. 2, 3). The shell 10 is then inserted in the weapon 24 in a corresponding way to that described in connection with FIGS. 1(*a–e*). In this embodiment and arrangement of the ammunition magazine 40 and transferring mechanism 30, the gun turret's 16 superstructure 14 can be made smaller than is the case with the embodiment in FIGS. 1(*a–c*).

As the transferring mechanism 18 described above can be used for different types and locations of ammunition magazine 12, 40, as shown in FIGS. 1 and 4, the variant costs for different applications are low.

Figure 5A:
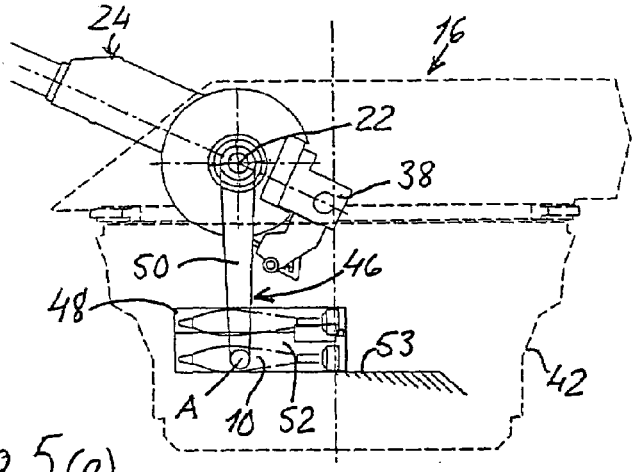
FIG. 5(*a*) is a schematic side view of a second embodiment of an arrangement according to the present invention, where a swing arm and an ammunition pickup unit in a retrieving position assume a first position at an angle to each other, in which a shell has just been received in a horizontal position from a gravity magazine located in a tray in a gun turret.
Figure 5B:
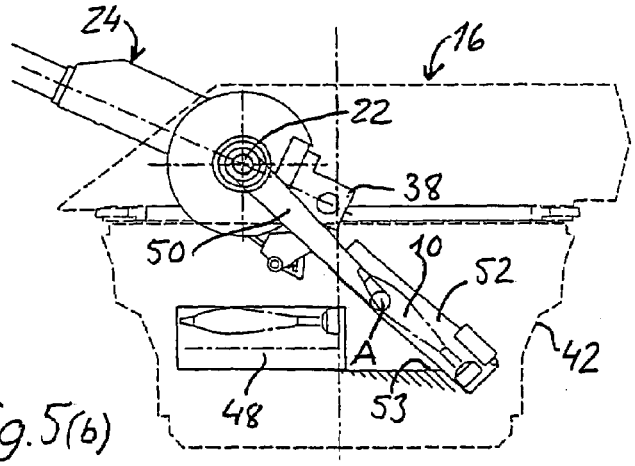
Figure 5C:
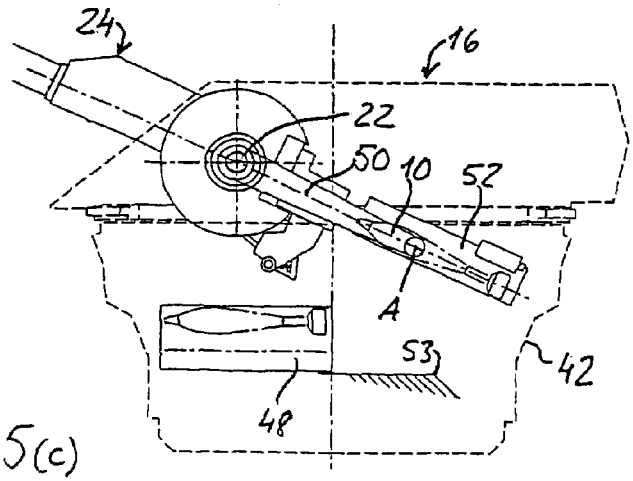

FIGS. 5(*a–c*) show an additional embodiment of a transferring mechanism 46 according to the invention. This embodiment is designed to receive horizontal shells from a gravity magazine 48 in the tray 42 of the gun turret 16. As with the embodiment according to FIGS. 1–4, the transferring mechanism 46 comprises a swing arm 50 which is arranged so that it can pivot on the horizontal axis 22 and carries at its free lower end a shell pickup unit 52. This unit 52 is mounted on the swing arm 50 in such a way that when it makes contact with a horizontal base 53 it is caused to assume a first angular position relative to the swing arm 50 in which it can receive shells 10 from the gravity magazine 48, as shown in FIG. 5(*a*). In this position, the weapon can recoil without its rear end 38 colliding with the transferring mechanism 46.

During a subsequent pivoting upwards of the swing arm 50 in a counter-clockwise direction in FIG. 5(*b*) towards a loading or ramming position behind the mortar 24, the shell pickup unit 52 is caused to be pivoted by the force of gravity in a clockwise direction around its bearing axis A on the swing arm 50 to its second angular position relative to the swing arm 50, as the centre of gravity of the unit 52 with the shell 10 carried therein lies on the right side of this bearing axis. In this embodiment, no spring device is thus required in order to urge the unit 52 towards its second angular position. In the position in FIG. 5(*c*), the swing arm 50 and the unit 52 assume a loading or ramming position for the shell 10 behind the mortar 24, where it can later be inserted into the breech of the mortar's barrel prior to firing.

The embodiments described above of an arrangement for retrieving and transferring large-calibre ammunition, such as shells, from an ammunition magazine to a loading position directly behind a large-calibre weapon have a very simple construction that can easily be adapted for different locations of the magazine in a gun turret and to the orientation (horizontal or vertical) of the ammunition units when they are taken out of the magazine. At the same time, the construction allows a very compact design of the gun turret and a high firing capacity of the weapon, in particular when it is designed to carry out loading of a double large-calibre weapon, mounted on one and the same horizontal axis of rotation in the gun turret.

The invention claimed is:

1. An arrangement for retrieving large-caliber ammunition from an ammunition magazine and transferring the ammunition to a loading and ramming position, in which a respective ammunition unit is located directly behind and coaxially aligned with a barrel of a large-caliber weapon, said barrel being pivotable around a horizontal axis to assume different elevation positions, the arrangement comprises:

a swing arm which is pivotally mounted around the horizontal axis between a retrieving position and a delivery position for each ammunition unit; and an ammunition pickup unit pivotally attached to the swing arm at a distance from the horizontal axis and pivotal from a first angular position relative to the swing arm for receiving an ammunition unit from the magazine, to a second angular position relative to the swing arm by the force of gravity to assume an ammunition delivery position thereof, said ammunition pickup unit being movable in a single vertical plane from the receiving to the delivery position of the pickup unit, said plane essentially coincides with a vertical plane through a longitudinal center axis of the barrel.

2. An arrangement according to claim 1, wherein the ammunition pickup unit is arranged to be brought to the first angular position thereof by engaging a contact surface adjacent to an ammunition outlet of the ammunition magazine.

3. An arrangement according to claim 2, wherein the contact surface consists of an essentially horizontal contact element on a bottom wall of a gun turret tray located below the weapon.

4. An arrangement according to claim 2, wherein the ammunition pickup unit is configured to receive the ammunition unit from the magazine through a longitudinal side wall of the pickup unit.

* * * * *